US005131197A

United States Patent [19]

Varga

[11] Patent Number: 5,131,197

[45] Date of Patent: Jul. 21, 1992

[54] MOUNTED STAIRWAY

[75] Inventor: Joseph S. Varga, Little Rock, Ark.

[73] Assignee: IMPO, Inc., Little Rock, Ark.

[21] Appl. No.: 660,730

[22] Filed: Feb. 25, 1991

[51] Int. Cl.[5] ..... E04F 11/00

[52] U.S. Cl. ..... 52/183; 182/228

[58] Field of Search ..... 52/182–191, 52/690; 182/97, 163, 228; 403/359, 408.1; 256/60, 63, 66, 67, 69; 411/399

[56] References Cited

U.S. PATENT DOCUMENTS

| | | | |
|---|---|---|---|
| 907,401 | 12/1908 | Prouty | 182/163 |
| 1,490,649 | 4/1924 | Vanderbeek | 403/359 |
| 2,864,542 | 12/1958 | Marryatt | 182/21 |
| 2,867,855 | 1/1959 | Xanten | 52/184 |
| 3,021,928 | 2/1962 | Blair | 52/690 |
| 3,456,757 | 7/1969 | Sain | 182/111 |
| 3,626,438 | 12/1969 | Cornell | 52/183 |
| 4,406,347 | 9/1983 | Stathopoulos | 182/97 |
| 4,631,880 | 12/1986 | Leicht | 52/183 |

FOREIGN PATENT DOCUMENTS

| | | | |
|---|---|---|---|
| 233229 | 9/1963 | Austria | 52/182 |
| 747634 | 12/1966 | Canada | 52/190 |

*Primary Examiner*—James L. Ridgill, Jr.

[57] ABSTRACT

The first preferred embodiment of the subject invention is a mounted stairway built on a central single stringer which utilizes stairs horizontally adjustable with regard to inclination of the stringer. The stairs are fixed in the middle by means of splined bolts which fit into splined apertures both of the stringer and tread angles. The railing posts are screwed into bushings of the tread and secured. Brackets screwed on railing post heads have swivels holding the rails in position.

The second embodiment is another option of the mounted stairway which utilizes two side stringers for wider stairs. The stairs in this case are fixed from aside by means of two splined bolts to match splined apertures of both stringers and tread angles.

3 Claims, 4 Drawing Sheets

MOUNTED STAIRWAY

FIELD OF THE INVENTION

This invention relates in general to the structure of housing or industrial complexes and in particular to a novel mounted stairway assembly.

BACKGROUND OF THE INVENTION

The present mounted stairway has a number of advantages over the prior art in that it is simple, adjustable, utilizes prefabricated parts which can be stored, shipped in bundle, and quickly mounted on site. The tested parts increase reliance and consequently reduce hazard in dwellings and industry as well.

The survey of the prior art shows that among few designs, the mounted stairway, as a structure, can be referred to the following inventions. U.S. Pat. No. 3,626,438 (Cornell) is an adjustable stairway which utilizes stairs with side supports in the form of adjustable parallelograms and therefore do not represent a rigid structure. In U.S. Pat. No. 4,631,880 (Leicht), the adjustable staircase includes a pair of channel section stringer members having spaced tread support pivots and tread locating apertures. Austrian Pat. No. 233229 (Lutz) utilizes railing brackets screwed in threaded sockets of concrete treads to accept railing posts, which may be considered unsafe. In U.S. Pat. No. 4,406,347 (Stathopoulos), the bracket is mounted directly to vertical support of the railing. A ladder stabilizer, disclosed in U.S. Pat. No. 3,456,757 (Sain), utilizes a boot which can be positioned by means of an arcuate slot cut in the angle wall.

SUMMARY OF THE INVENTION

In the first preferred embodiment of the invention, a splined bolt is utilized to keep in horizontal position and fasten the stair to a single central stringer. The splined bolt has the same pattern of grooves as the splined apertures either in the stringer or tread angle. The tread is firmly adjusted in horizontal position, with regard to the inclination of the stringer. The stringer, splined bolts and tread angles are made exclusively of steel, while the treads and railing may be wooden, when used in dwellings. The railing posts are screwed into a threaded bushing of the tread, and secured against rotation by pin. Stairways with a central stringer are recommended mainly for industrial use with limited space and infrequent passage. In a compact stairway, two tread angles, embracing the central stringer, may be engaged.

The second preferred embodiment of the invention utilizes a pair of side stringers in stairways having wider treads. It also differs from the first embodiment in that the treads are equipped with two angles on both ends and held in the horizontal position by two side stringers. Such a structure yields increased loading capability and comfort, therefore is recommended for dwellings with frequent passage.

DETAILED DESCRIPTION OF THE PREFERRED EMBODIMENTS

Figure 1:
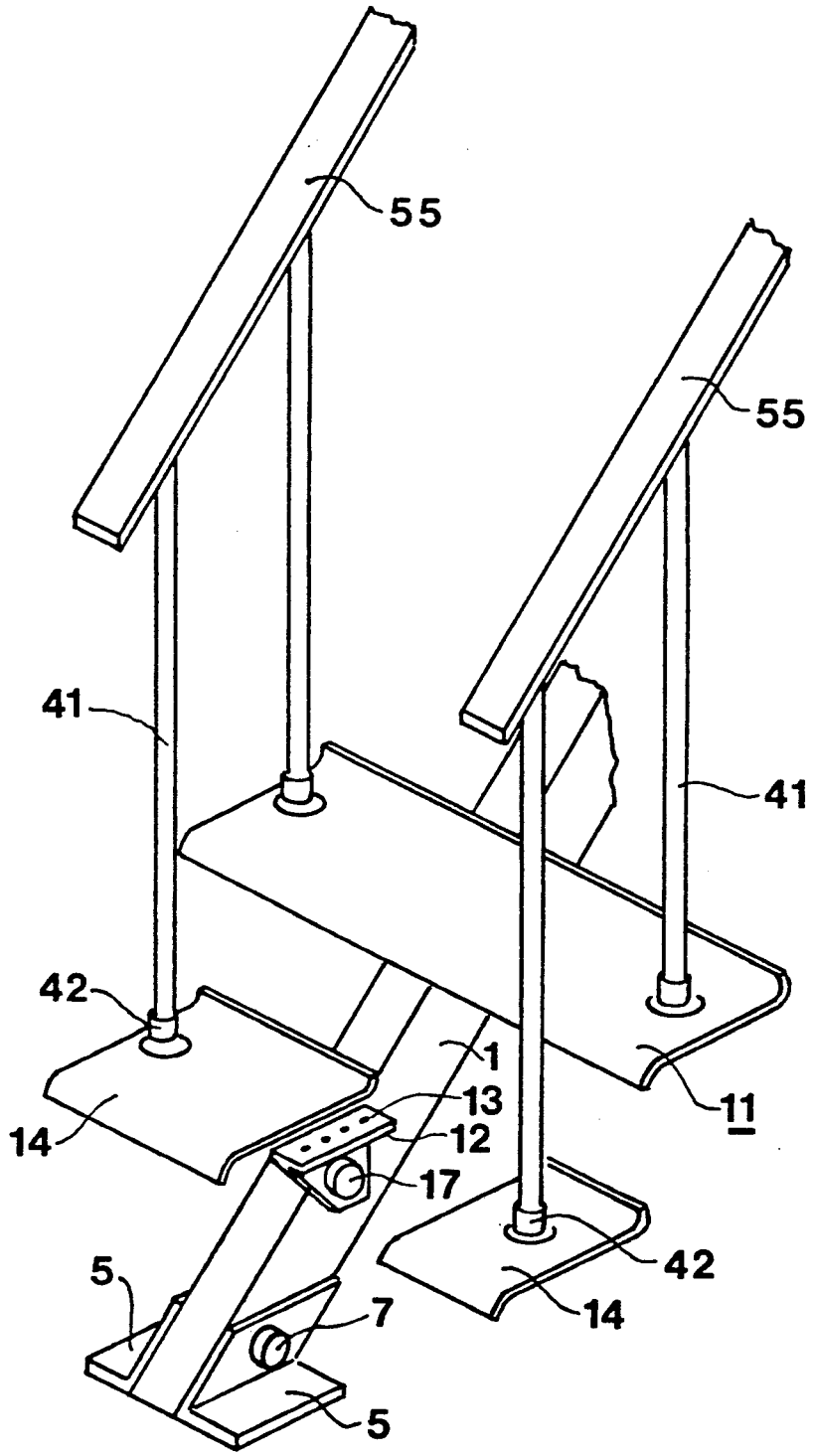
FIG. 1 is a perspective view of the first preferred embodiment illustrating a mounted stairway assembly with a central stringer.

FIG. 1 generally illustrates the first preferred embodiment.

Figure 2:
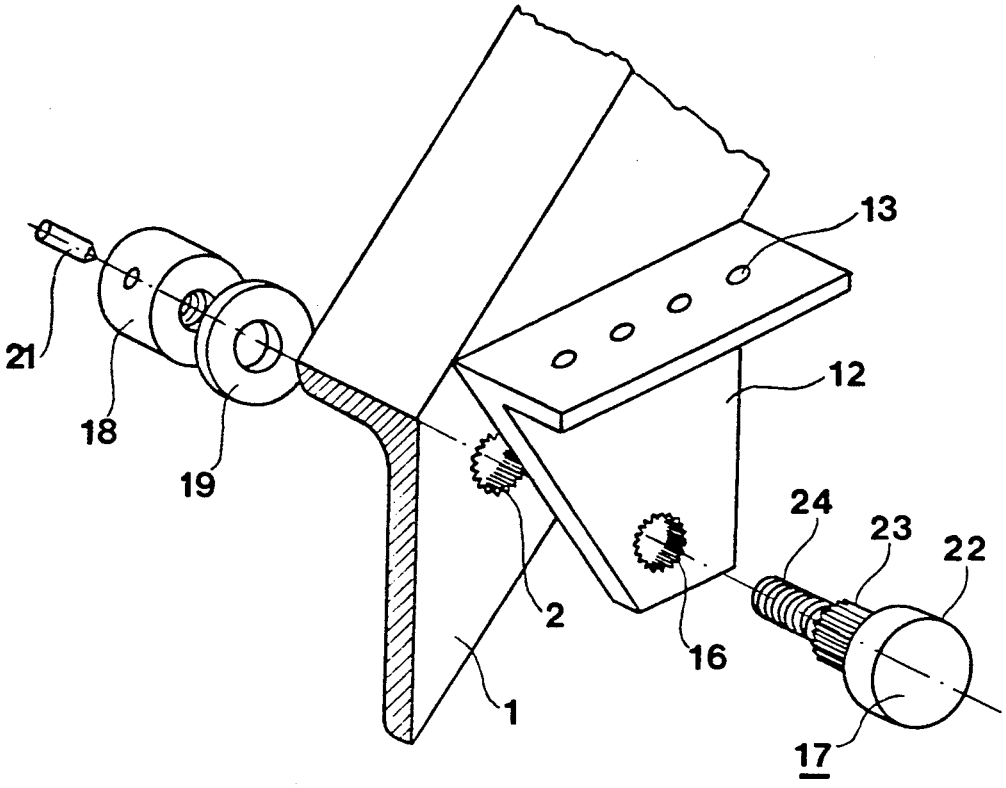
FIG. 2 in a perspective view illustrates a disassembled stairway portion with a single tread angle, central stringer and interlocking splined bolt.
Figure 3:
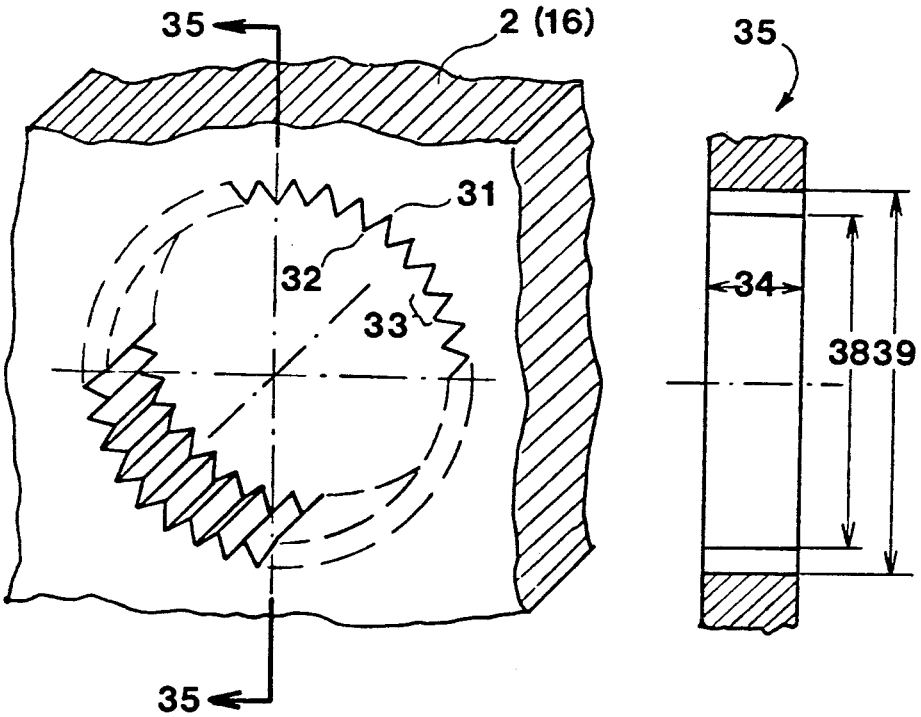
FIG. 3 displayes the pattern of the splined aperture both in the stringer and tread angle.
Figure 5:
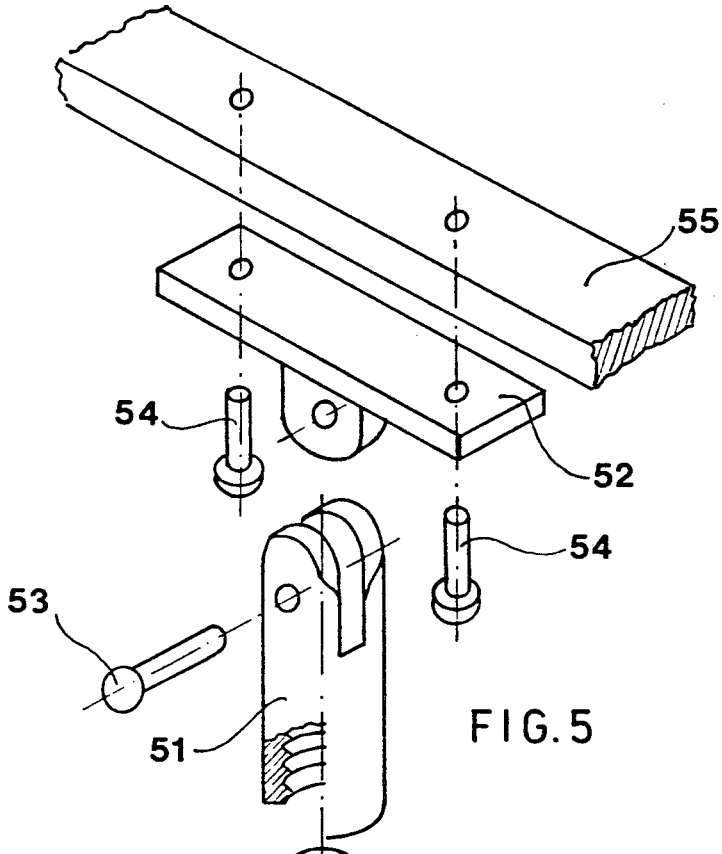
FIG. 5 is a perspective view of the disassembled railing.
Figure 6:
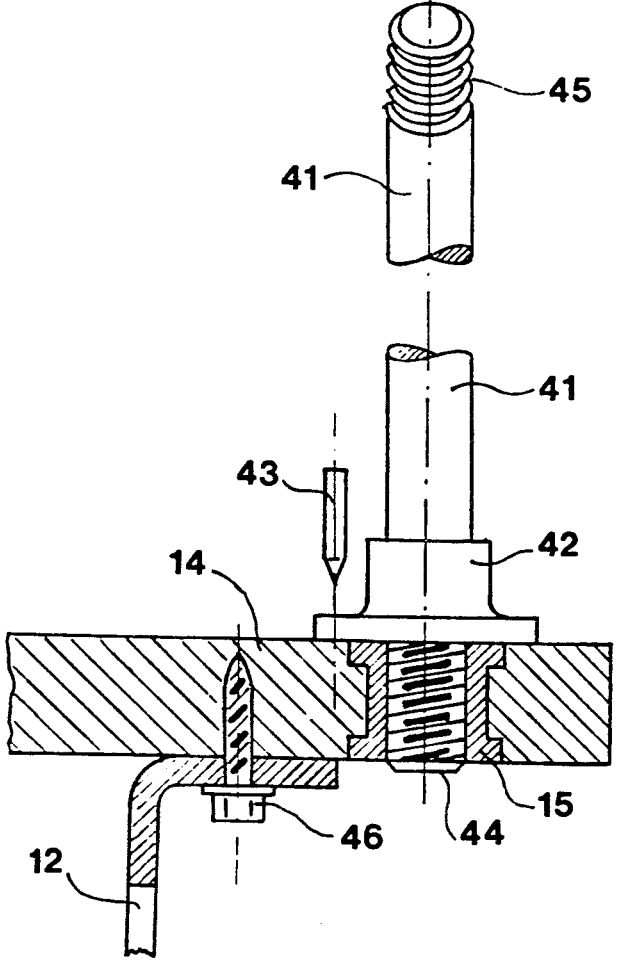
FIG. 6 is a cross-sectional view of the stair with a railing rod screwed in bushing.

Details of mounting the stairs illustrated in FIG. 2, the detailed splined aperture of FIG. 3, and details of the railing shown in FIGS. 5 and 6, are applicable for both embodiments.

The central stringer supports the stairs 11 and is equipped with a number of splined apertures 2 arranged in a line, including a foot opening and a head opening to fasten the central stringer in stairfoot 5 and stairhead 6. Each stair 11 is then fixed to the stringer in horizontal position by means of a splined bolt 17, nut 18, washer 19 and secured by a pin 21. The splined bolt 17 is characterized by head 22, neck with splined grooves 23 and threaded end 24. Splined bolts 7 and 8, fastening the stringer to stairfoot and stairhead, are similar or identical to splined bolts 17.

A stair assembly 11 includes a single or double angle 12 riveted 13 or welded to tread 14 in the centre, and bushings 15 located on both ends of the tread. All parts of the stair 11 form a solid structure.

The outline of the splined apertures 2 and 16 are shown in FIG. 3. The splined grooves 23 of bolt 17 match the polypointed star 31 pattern of apertures in stringers 1 and tread angles 12. A minimum 10° tread adjustment requires a 36 pointed star pattern with equilateral triangle teeth 32 of pitch 33 measured on inside diameter 38 of the aperture. In this case, the tooth thickness 34 is identical to wall thickness of the stringer, shown in a cutaway view 35. A cross section of the aperture, exposed to maximum shear stress is then:

*pi x (inside diameter) × (tooth thickness).*

The railing consists of a threaded bracket 51, swivel 52, pivot 53, rivets 54, rail 55, and railing post 41. The railing posts are screwed 44 into threaded bushings 15 and secured by a pin 43 or their sleeves 42 point welded to the tread. In the final stage, brackets 51 are screwed 45 on railing posts, positioned, rails riveted or fastened otherwise to swivels.

Figure 4:
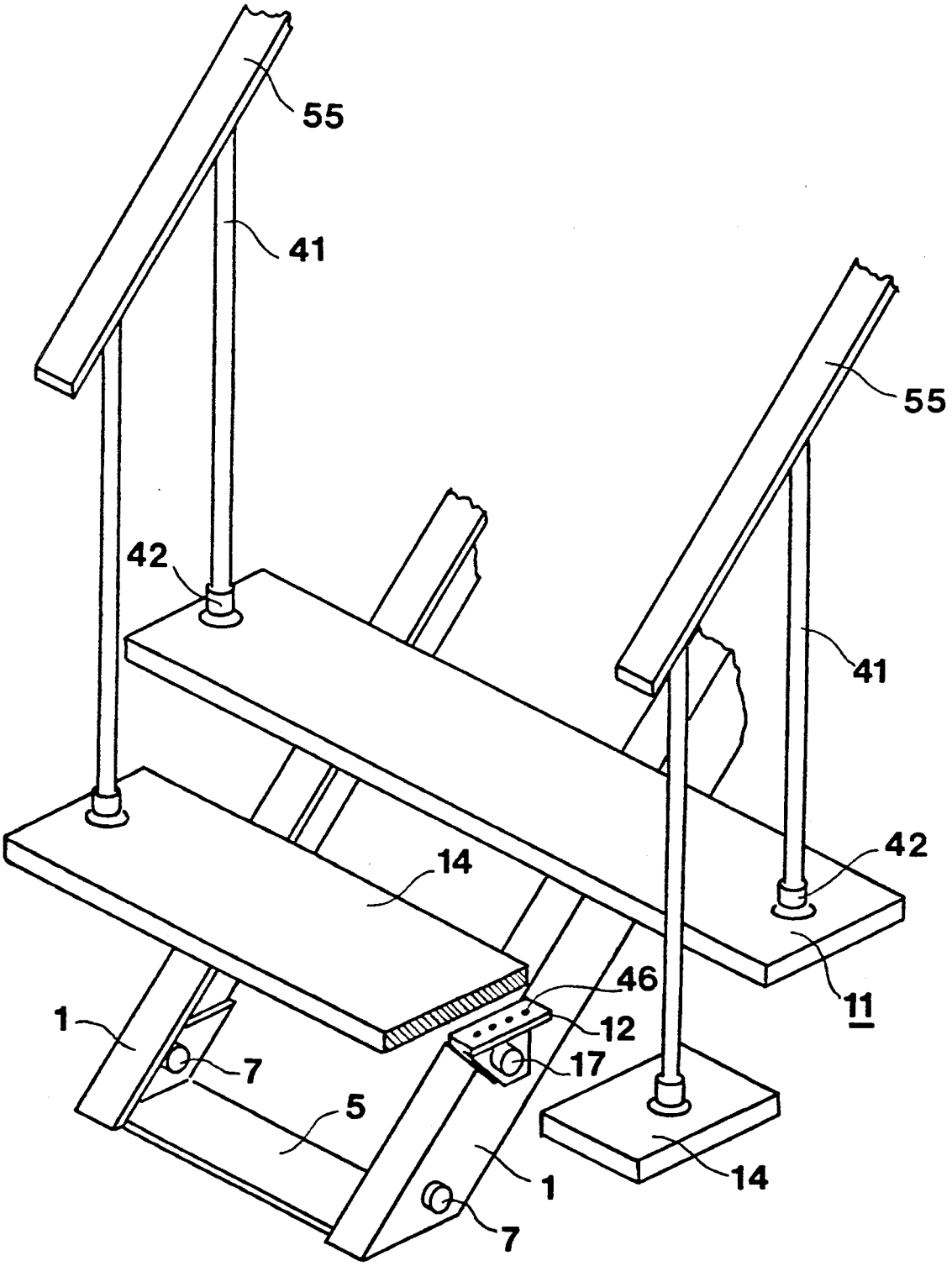
FIG. 4 a perspective view of the second preferred embodiment shows a mounted stairway assembly with two side stringers.

FIG. 4 generally illustrates the second preferred embodiment. It differs from the first embodiment in that instead of a single central stringer it utilizes two side stringers 1.

Exclusively for this case, the wooden treads 14 are fixed to angles 12 by screws 46.

What is claimed is:

1. A mounted stairway comprising:

a support, consisting of a single stringer having a substantially narrow portion with a row of splined apertures, centrally positioned in longitudial array thereon;

a multitude of tread angles each equipped with one splined aperture, wherein said apertures both of the angle and stringer are identical;

a multitude of treads each having one or two said angles mounted in the middle of said treads with respect to said stringer, and bushings to accept railing posts;

a multitude of fasteners, including splined bolts, washers, nuts and securing pins to mount the angles fixedly to the stringer, wherein the splined grooves of said bolt match the apertures of both stringer and angle;

a multitude of railing posts equipped with a flange and threaded end to be screwed into bushings of said treads;

a multitude of railing brackets, threaded inside to accept railing posts, equipped with a swivel on pivot for mounting said brackets to rail;

a pair of stairfoots, each consisting of an angle with a number of openings in its horizontal portion for being fixed into base and one splined aperture in its vertical portion for accepting said splined bolt;

a pair of stairheads, each consisting of an angle with a number of openings in horizontal portion for being fixed into floor and one splined aperture in its vertical portion for accepting said splined bolt.

2. A mounted stairway according to claim 1, wherein said support comprises: two stringers, located on both sides of said stairway.

3. A mounted stairway according to claim 1, wherein said tread comprises:

a multitude of treads each having two angles mounted on both sides of a tread with respect to said stringers according to claim 2.

* * * * *